United States Patent [19]

Tseng

[11] Patent Number: 4,586,882

[45] Date of Patent: May 6, 1986

[54] TUBING OCCLUDER PUMP

[75] Inventor: Charles C. Tseng, Lake Bluff, Ill.

[73] Assignee: Baxter Travenol Laboratories, Inc., Deerfield, Ill.

[21] Appl. No.: 678,910

[22] Filed: Dec. 6, 1984

[51] Int. Cl.[4] ..... F04B 43/12; F04B 45/08

[52] U.S. Cl. ..... 417/477; 417/474

[58] Field of Search ..... 417/474, 475, 476, 477

[56] References Cited

U.S. PATENT DOCUMENTS

| | | | |
|---|---|---|---|
| 2,412,397 | 12/1946 | Harper | 417/474 |
| 3,083,647 | 4/1963 | Muller | 417/474 |
| 3,137,242 | 6/1964 | Hahn | 417/477 |
| 3,784,323 | 1/1974 | Sausse | 417/477 X |

*Primary Examiner*—Richard E. Gluck

*Attorney, Agent, or Firm*—Paul C. Flattery; James D. Ryndak; Kay H. Pierce

[57] ABSTRACT

A tubing occluder pump is provided that includes a structure for occluding flexible tubing that distributes a relatively low amount of force at the transverse center portion of the tubing during occlusion and a relatively large force at the distal transverse ends of the occluded tubing, utilizing a mechanical advantage. The occluding structure includes a recessed first occluding surface and a projecting occluding surface. The tubing occluding surface is configured so that one-half of a transverse section of occluded tubing generally conforms to its original shape and so that most of the strain energy stored within the occluded tubing is utilized to return the other half of the tubing to an open position. The occluding structure may form part of either a peristaltic pump or a linear pump.

23 Claims, 12 Drawing Figures

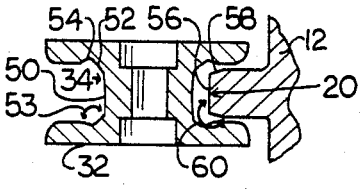
FIG. 3
FIG. 4
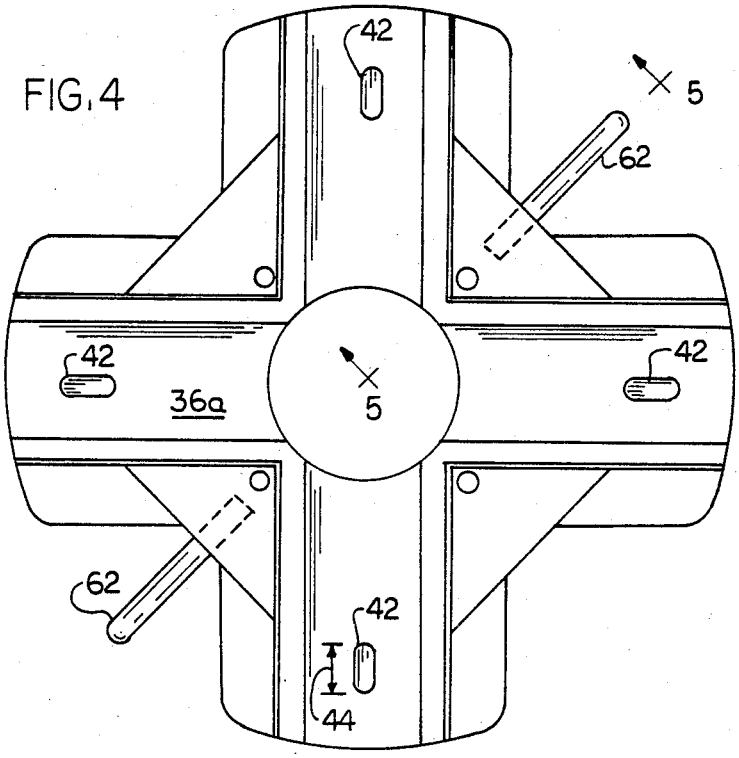
FIG. 5
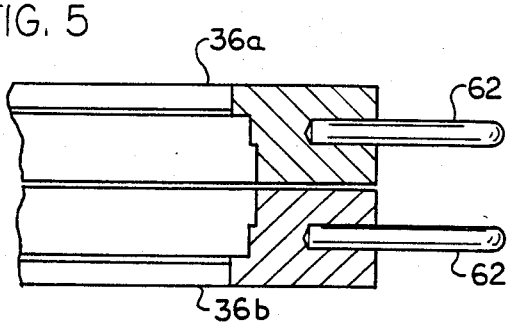

TUBING OCCLUDER PUMP

FIELD OF THE INVENTION

The present invention relates to pumping apparatus and more particularly to tubing occluder pumps.

BACKGROUND ART

Often, in medical applications and other applications where maintaining sterile conditions is important or necessary, it is desirable to pump fluid through tubing without contact between the fluid and the pumping apparatus. Various types of tubing occluder pumps are known for this purpose, namely, peristaltic pumps and linear pumps. Linear pumps are also commonly known as finger pumps. In each of these types of pumps, fluid is pumped as a result of periodically occluding transverse sections of flexible tubing.

In a peristaltic pump, two or more rollers periodically longitudinally traverse a length of tubing while transversely occluding the cross section of tubing where contact is made to displace the fluid through the tube. The periodic traversal and occlusion of the length of tubing is achieved in a peristaltic pump by rotation of a pump head which carries two or more rollers. Usually, four rollers are utilized. The rollers traverse a section of tubing located between a housing and the pump head. Flat, cylindrical rollers have been used in the past to occlude the tubing against the housing which has a curvature generally corresponding to the radius of the pump head. The result is that the tubing is occluded between a roller and the housing in a manner similar to the occlusion of tubing between two flat surfaces.

In a linear pump, a plurality of occluding members periodically serially occlude different transverse sections of tubing located between the members and a housing or back-up plate. The occluding members linearly advance on and retract from the tubing in a direction normal to the housing or back-up plate.

It would be advantageous to provide a tubing occluder pump which requires less torque or power to pump a given volume of fluid. It would also be advantageous to provide a tubing occluder pump which extends the life of the tubing associated with the pump.

DISCLOSURE OF THE INVENTION

In accordance with the present invention, an improvement in tubing occluder pumps is provided.

Briefly, the invention provides a tubing occluder pump where fluid is pumped by the periodic occlusion of transverse sections of flexible tubing along a length thereof in which structure having a particular geometry is provided for occluding the tubing. The occluding structure results in less torque being required to displace a given volume of fluid. The reduced torque allows a significant reduction in, for example, motor size, power consumption, power supply and noise. In addition, the occluding structure utilizes strain energy, which is stored in the tubing as a result of tubing occlusion in a particular way, to induce tubing shape restoration when the tubing occluding force is removed. A further important effect is that the life of the tubing that is occluded is increased because of the design of the occluding structure. An improvement in the accuracy of the desired flow rate can also be obtained.

In accordance with the invention, the tubing is occluded in a manner which utilizes a mechanical advantage that results from the geometry of the occluding structure, which also minimizes cold working of the flexible tubing.

Because the occluding structure improves the tubing springback and increases the tubing life, the reliability of tubing occluder pumps is improved. This can be especially important for medical uses, such as dialysis and other types of blood processing.

The tubing occluding structure includes a recessed first occluding surface and a projecting second occluding surface which are arrayed so that the desired periodic occlusion of transverse sections of the flexible tubing occurs between the two occluding surfaces.

The recessed first occluding surface defines a transverse cross-section at the areas of contact with the transverse sections of the tubing during occlusion of a segment of tubing. The transverse cross-section has a slightly concave mid-portion, generally of a length equal to about one-half the inner circumference of the tubing and at each end of the concave mid-portion is a sloped, straight portion. Each sloped, straight portion forms an angle at the intersection with the slightly concave mid-portion of between about 120° and 150°, preferably 135°. The length or each sloped straight portion is preferably about one-third to one-quarter of the length of the concave mid-porton.

The transverse cross-section of the recessed occluding surface further includes a concave side defining an indentation in the first occluding surface cross-section at the end of each sloped, straight portion opposite the end at the slightly concave mid-portion. Each of said concave sides is preferably curved and has a radius of curvature of about one-third of the radius of curvature of the tubing.

The recessed first tubing occluding surface may be in the form of the rollers or the housing in a peristaltic pump or as the fingers or the back-up plate in a linear pump.

The projecting second occluding surface defines a wedge-shaped transverse cross-section at the areas of contact with the transverse sections of the tubing during occlusion. The cross-section of the second tubing occluding surface includes a straight mid-portion of a length equal to about one-half of the inner circumference of the tubing for urging a transverse portion of the tubing against the slightly concave mid-portion cross-section of the first occluding surface. The transverse cross-section the second tubing occluding surface includes a straight side portion that extends from the straight mid-portion at each end of the straight mid-portion. Each straight side portion forms an angle with the inner section of the straight mid-portion of between about 225° and 270°, preferably 255°, for urging transverse ends of the transverse portion of the tubing against the sloped and concave side portions of the first occluding surface with a mechanical advantage. Preferably, the intersection of each of said side portions with said straight mid-portion is a rounded corner for facilitating the distribution of forces on the tubing and for preventing sharp tubing deformation.

The second or projecting tubing occluding surface may be in the form of the rollers or housing in a peristaltic pump or as the fingers or the back-up plate in a linear pump.

In one embodiment of the invention, the tubing occluder pump is a peristaltic pump. This pump includes a pump head that carries a plurality of rollers. Each of the rollers defines one of the tubing occluding surfaces previously described. The peristaltic pump further includes a housing having a curved surface that defines the other of the tubing occluding surfaces.

In the embodiment where the rollers define the recessed first tubing occluding surface, each of the rollers includes a central, slightly concave roller surface that defines the slightly concave cross-section of the first occluding surface. Each roller further includes a sloped, planar roller surface that extends from each side of the slightly concave roller surface which defines the sloped, planar straight portions of the first occluding surface cross-section. Finally, each roller also defines a concave side roller surface at the outer peripheral end of each of the sloped planar roller surfaces. The concave side roller surface defines the concave side indentations of the first occluding surface cross-section.

Further in accordance with this embodiment, the housing defines the projecting second occluding surface and includes a central flat surface that defines the straight mid-portion of the wedge-shaped transverse cross-section and a peripheral flat surface at each side of the central flat surface of the housing that defines the straight side portions of the wedge-shaped transverse cross-section of the projecting tubing occluding surface.

In the embodiment where the rollers of the peristaltic pump define the projecting second occluding surface, each of the rollers may be wedge-shaped and include a central planar roller surface that defines the straight midportion of the wedge-shaped transverse cross-section. Each of the rollers may further include a peripheral planar surface at each side of the central planar roller surface that defines the generally straight side portions of the wedge-shaped transverse cross-section of the projecting tubing occluding surface.

This embodiment further includes a housing with a curved surface that defines the recessed first tubing occluding surface. The housing surface includes a central slightly concave housing surface that defines the slightly concave cross-section of the first recessed occluding surface and a sloped, planar housing surface that extends from each side of the slightly concave housing surface that defines the sloped straight portions of the first occluding surface cross-section. Finally, the housing surface includes a concave housing surface at the side of the sloped planar housing surfaces opposite the slightly concave housing surface that defines the concave side indentation of the first or projecting occluding surface cross-section.

In accordance with another embodiment of the present invention, a tubing occluder pump is provided that is a linear pump or finger pump. The linear pump in accordance with the invention includes a recessed first tubing occluding surface and a projecting second tubing occluding surface as previously described.

The linear pump includes a plurality of pump fingers that are periodically serially movable to periodically occlude distinct transverse sections of tubing for pumping fluid therethrough. Each section of periodically occluded tubing is located between one of the pump fingers and the pump housing. Each of the fingers defines one of the tubing occluding surfaces and the pump housing defines the other of the tubing occluding surfaces.

In the linear pump embodiment where the pump fingers define the recessed first occluding surface, each pump finger includes a recessed tubing occluding surface that has a slightly concave mid-portion surface that defines the slightly concave cross-section of the recessed first occluding surface. Each pump finger surface further includes a sloped, planar surface extending from each side of the slightly concave finger surface that defines the sloped planar straight portions of the first occluding surface cross-section. Each pump finger surface also includes a concave side surface at the end of each of the sloped, planar finger surfaces, opposite the end of the sloped, planar finger surfaces at the slightly concave finger surface, that defines the concave side indentations of the first occluding surface cross-section.

In this embodiment, the pump housing or back-up plate defines the projecting second occluding surface and includes a planar mid-portion surface defining the straight mid-portion of the wedge-shaped transverse cross-section. The housing further includes a peripheral planar surface at each end of said planar mid-portion surface defining the straight side portions of the wedge-shaped transverse cross-section.

In the linear pump embodiment where the pump fingers define the projecting second occluding surface, each of the pump fingers is wedge-shaped and includes a central planar finger surface defining the straight mid-portion of the wedge shaped transverse cross-section. Each finger surface further includes a peripheral planar surface at each end of said planar mid-portion surface defining the straight side portions of the wedge-shaped transverse cross-section.

In this embodiment, the pump housing or back-up plate defines the recessed first occluding surface and includes a slightly concave mid-portion surface defining the slightly concave cross-section of the recessed first occluding surface. The housing further includes a shaped, planar surface extending from each side of the slightly concave surface and defines the sloped, straight portions of the first occluding surface cross-section. At the end of each sloped, planar surface opposite the end at the slightly concave surface is a concave surface that defines the concave side indentations of the first occluding surface cross-section.

BRIEF DESCRIPTION OF THE DRAWINGS

The invention can be more completely understood by reference to the accompanying drawings in which:

FIG. 3 is an enlarged cross sectional view of the pump roller and housing surface utilized in the peristaltic pump of FIG. 1 illustrating transverse cross sections of the occluding surfaces;

FIG. 4 is an elevation view of a portion of the pump head assembly of the pump of FIG. 1;

FIG. 5 is a side view of a portion of the pump head assembly of FIG. 4;

Figure 6:
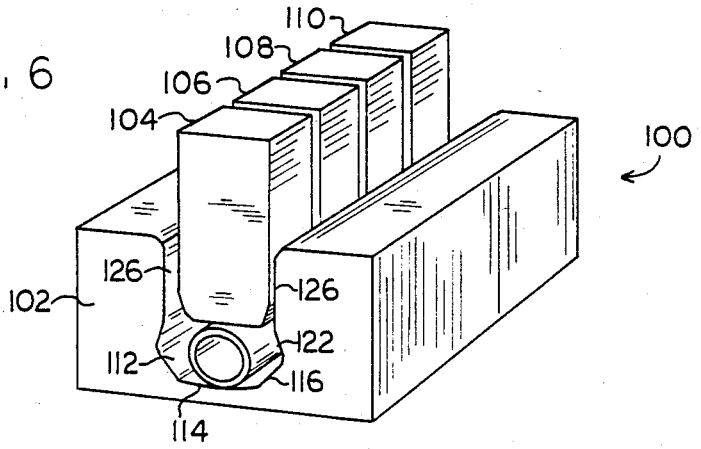
FIG. 6 is a perspective view of a linear pump in accordance with the invention.
Figure 7:
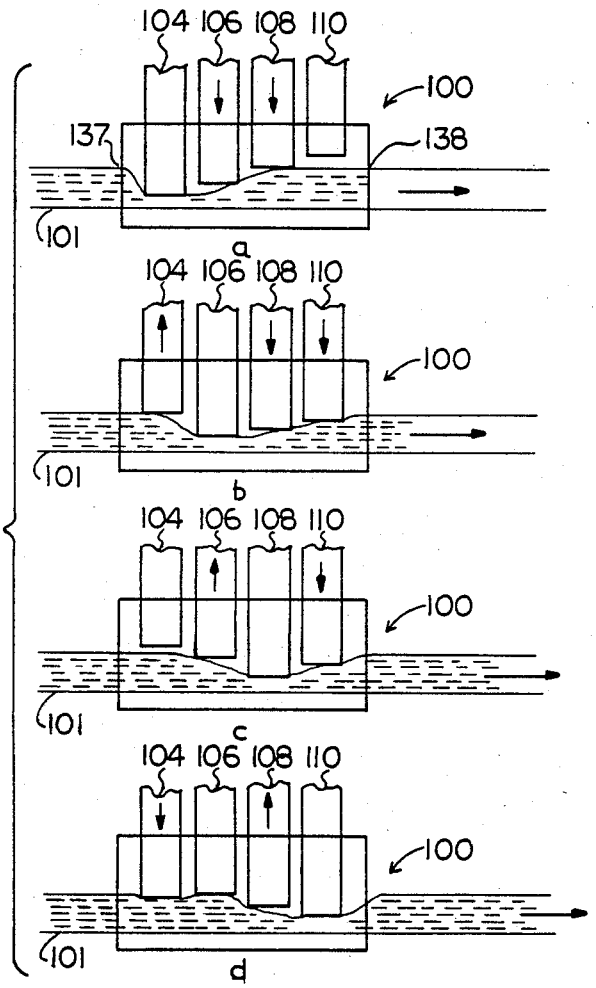
Figure 8:
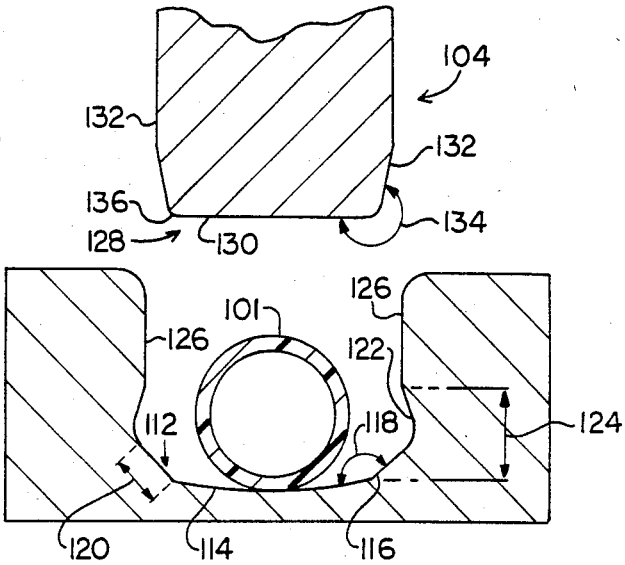
Figure 9:
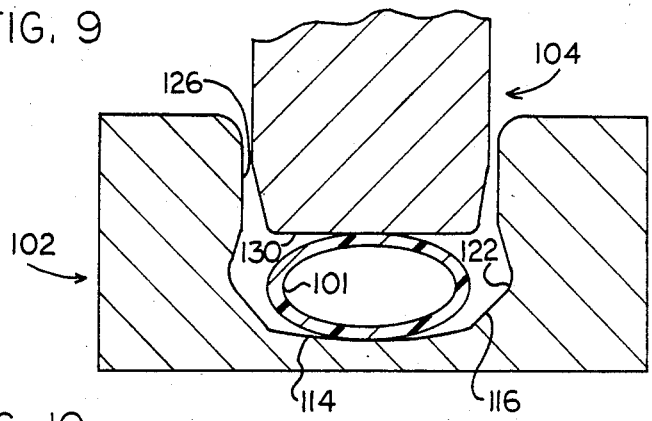
Figure 10:
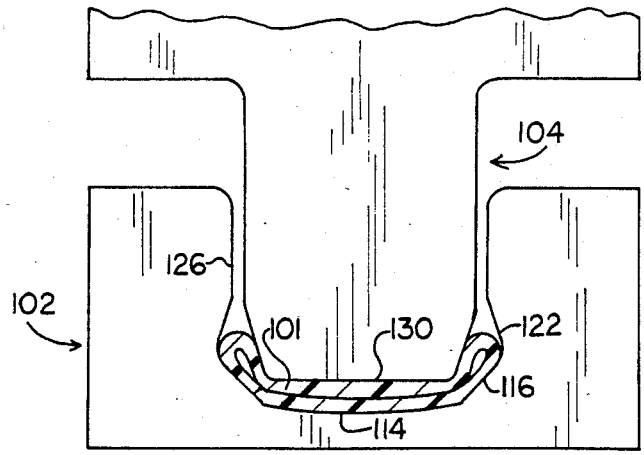
Figure 11:
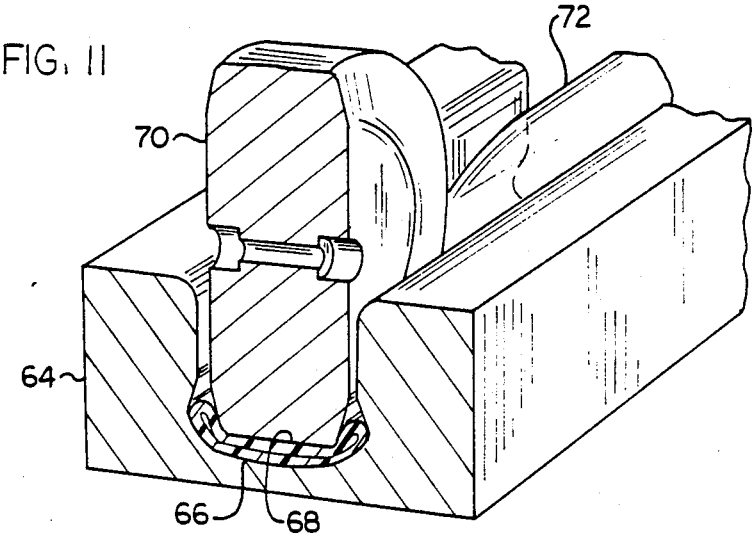
Figure 12:
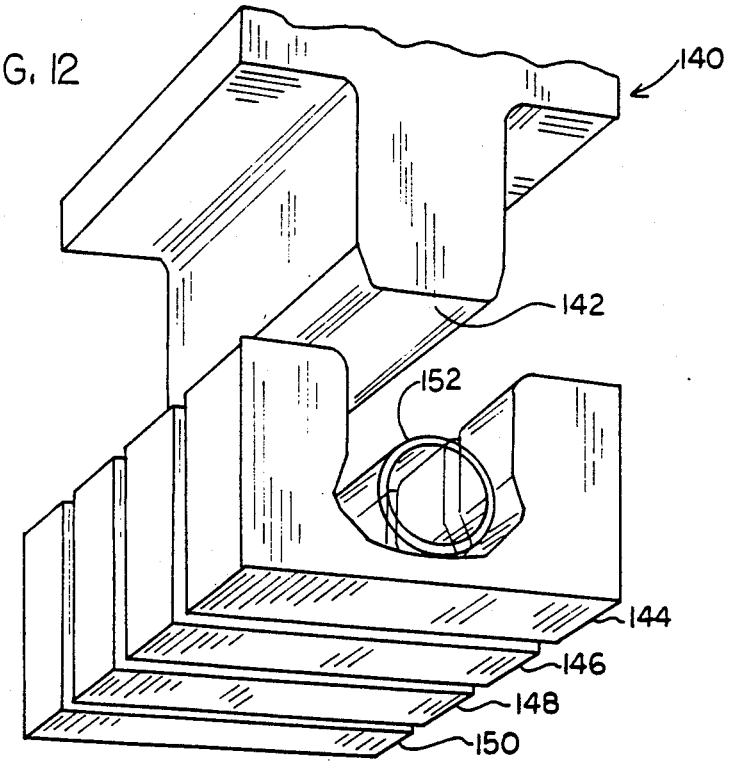

FIGS. *7a–d* are a side view of the linear pump of FIG. 6 illustrating part of a pumping cycle;

FIG. 8 is a cross sectional elevation view of the linear pump of FIG. 6 illustrating an unoccluded transverse section of tubing;

FIG. 9 is a cross sectional elevation view of the linear pump of FIG. 6 illustrating partially occluded transverse section of tubing;

FIG. 10 is a cross sectional elevation view of the linear pump of FIG. 6 illustrating an occluded transverse section of tubing;

FIG. 11 is a cross sectional view of an alternate embodiment of part of a peristaltic pump in accordance with the present invention; and FIG. 12 is a cross sectional view of an alternate embodiment of part of a finger pump in accordance with the present invention.

DETAILED DESCRIPTION

In the following Detailed Description, the structure and operation of peristaltic and linear pumps is not described in great detail since such devices are well known in the art. The specifically described embodiments are given by way of example only are not to be construed as a limitation upon the invention.

Figure 1:
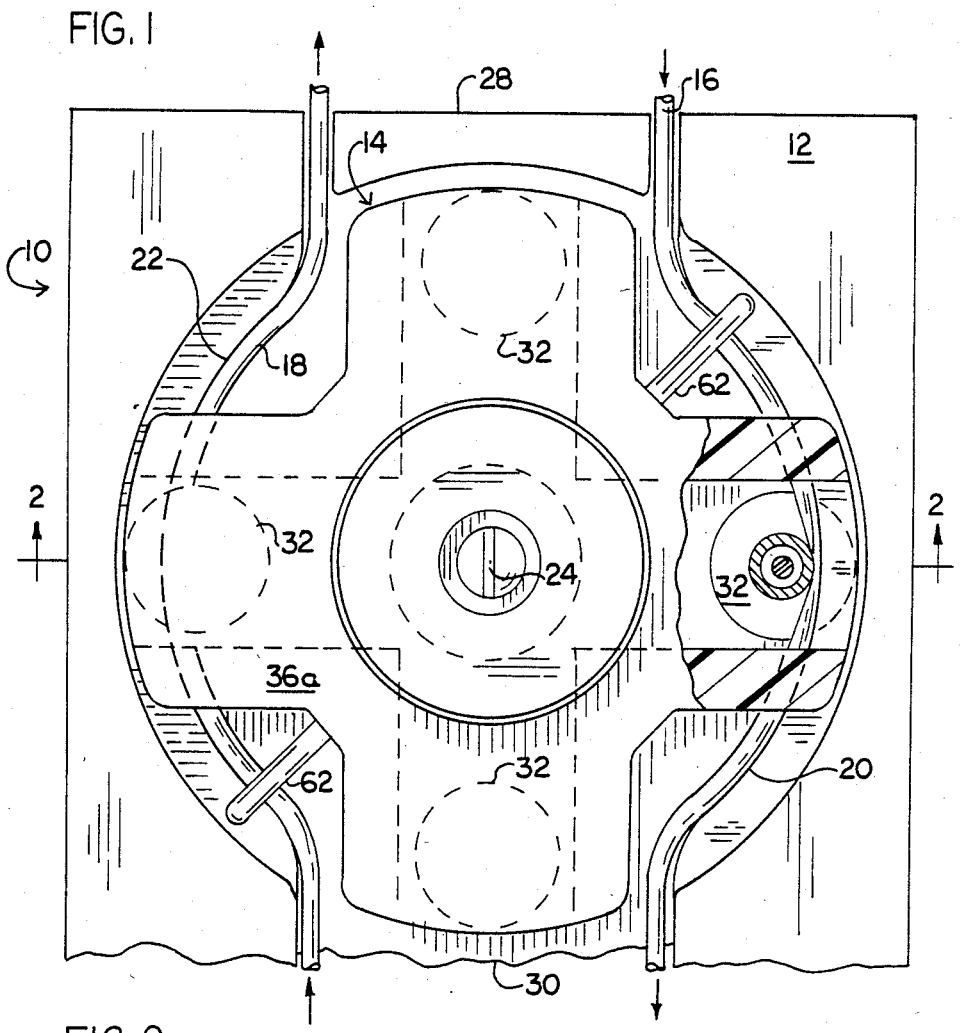
FIG. 1 is an elevation view of a peristaltic pump in accordance with the invention.

Referring now to the drawings generally and in particular to FIG. 1, there is illustrated a peristaltic pump in accordance with the present invention, generally referred to by reference numeral 10.

Peristaltic pump 10 includes a housing 12 and a pump head 14. It is to be understood that the particular peristaltic pump described is given by way of illustration only, and is not a limitation upon the present invention. Any peristaltic pump using the occluding geometry as disclosed herein is within the scope of the invention.

Housing 12 defines a pathway for flexible tubing 16 and flexible tubing 18 that is defined in the area where tubing 16 and 18 undergoes periodic occlusion by projecting tubing occluding surfaces 20 and 22.

Flexible tubing 16 and 18 may be constructed of flexible polyvinyl chloride or other types of tubing which may be suitable for peristaltic pumps.

Figure 2:
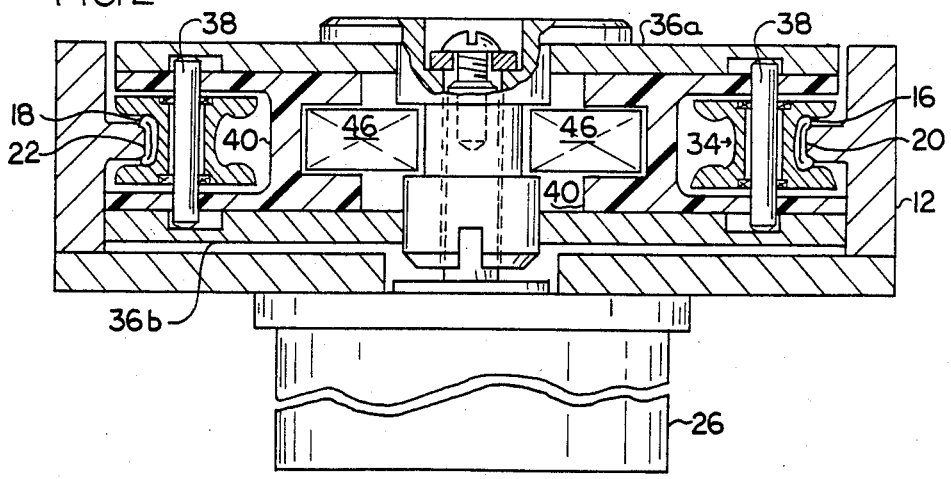
FIG. 2 is a sectional view of the peristaltic pump of FIG. 1 along lines 2—2 of FIG. 1.

In the illustrated embodiment, pump head 14 is mounted for clockwise rotation about axis 24, which is a shaft driven by motor 26, as illustrated in FIG. 2, or some other suitable source of power.

As shown in FIG. 1, the flow of fluid through tubing 16 is from the top portion 28 of housing 12 to the bottom portion 30 of housing 12. Conversely, the flow of fluid through flexible tubing 18 is from the bottom portion 30 to top portion 28 of housing 12.

While the specifically illustrated peristaltic pump in FIG. 1 is of the type where fluid is pumped through to two distinct tubes, in another common tubing configuration, one tube would enter where flexible tubing 16 enters housing 12 and traverse projecting tubing occluding surfaces 20 and 22 and exit where flexible tubing 18 exits housing 12.

Pump head 14 carries four identical rollers 32, each roller 32 spaced at 90 degree intervals along the periphery of pump head 14. Each roller 32 defines a first or recessed tubing occluding surface 34 as more clearly illustrated in FIGS. 2 and 3, as hereinafter described in greater detail. Rollers 32 are preferably constructed of resilient material or have a surface of resilient material, such as hard rubber.

In the operation of peristaltic pump 10, pump head 14 rotates in a clockwise direction carrying rollers 32 which are mounted for rotation about their longitudinal axes. As pump head 14 rotates at a desired speed, which controls the flow rate through flexible tubing 16 and 18, each of rollers 32 will traverse the portions of flexible tubing 16 and 18 that are adjacent projecting tubing occluding surfaces 20 and 22, respectively. When one of rollers 32 begins to traverse either of projecting tubing occluding surfaces 20 or 22, the flexible tubing adjacent to that occluding surface is transversely compressed to a point where the flexible tubing is completely occluded or essentially completely occluded. As a roller continues to traverse the flexible tubing adjacent that projecting tubing occluding surface, fluid contained within that portion of the flexible tubing will be displaced through the flexible tubing towards the pump outlet.

Pump head 14, which carries four rollers 32, includes an outer housing which comprises two opposing exterior housing members 36*a* and 36*b*, four roller shafts 38, four spring loaded shaft housing members 40 and four springs 46.

Referring to FIG. 2 and to FIG. 4, which illustrates an elevation view of the interior facing surface of exterior housing member 36*a*, each of opposing exterior housing members 36*a* and 36*b* includes an oval aperture 42 for each roller shaft 38 of pump head 14. Each of oval apertures 42 acts as a guide for roller shafts 38 allowing movement of the shafts normal to axis 24 of pump head 14. The length 44 of oval apertures 42 define the maximum and minimum travel distances of rollers 32 from projecting tubing occluding surfaces 20 and 22 so the desired occlusion of the tubing can be achieved.

Spring loaded members 40 which carry roller shafts 38 are mounted for slideable movement normal to axis 24 of pump head 14. A spring 46 is provided for each of spring loaded shaft housing members 40 for urging spring loaded shaft housing members 40 axially outwardly so that rollers 32 are urged against the flexible tubing contained between rollers 32 and projecting tubing occluding surfaces 20 and 22. The compression of springs 46 is such that a desired occluding force is achieved between rollers 32 and projecting tubing occluding surfaces 20 and 22. The desired force will depend upon the particular tubing that is utilized. For example, if the tubing is relatively flexible and requires a relatively low force for occlusion, relatively light springs 46 would be utilized. Similarly, if the tubing is relatively stiff and requires a relatively large force for occlusion, springs 46 would be relatively heavy.

FIG. 3 illustrates a cross sectional view of the configuration of one of rollers 32 and the projecting tubing occluding surface 20 of housing 12. As illustrated therein, roller 32 includes recessed tubing occluding surface 34 that includes a central slightly concave roller surface 50. Central slightly concave surface 50 defines a slightly concave cross section of recessed tubing occluding surface 34 which has a width equal to about one-half of the inner circumference of the tubing. A sloped, planar roller surface 52 extends from each end of slightly concave roller surface 50 and defines a sloped straight portion of the cross section of recessed tubing occluding surface 34. Preferably, each of sloped planar roller surfaces 52 are of a width equal to about one-third to one-quarter of the width of slightly concave rollers surface 50. As illustrated in FIG. 3, each of sloped, planar rollers surfaces 52 form an angle at the intersection with slightly concave roller surface 50 of about 135°.

A concave side roller surface 54 is provided at the outer peripheral end of each of sloped, inner roller surfaces 52 and defines the concave side indentation of recessed tubing occluding surface 34.

Projecting tubing occluding surface 20, similar to projecting tubing occluding surface 22, defines a wedge-shaped transverse cross section. Projecting tubing occluding surface 20 includes a central flat surface 56 which defines the straight mid-portion of the wedge-shaped transverse cross section and is prefereably of a width equal to about one-half of the inner circumference of the tubing. Projecting tubing occluding surface of housing 12 also includes a peripheral flat surface at each side of central flat surface 56 which defines straight side portions of the wedge-shaped transverse cross section of projecting tubing occluding surface 20. Preferably, the angle 60 formed by the intersection of central flat surface 56 and peripheral flat surface 58 is about 255°.

In operation, central flat surface 56 urges a transverse section of the tubing against central slightly concave roller surface 50 and peripheral flat surface 58 urges the peripheral portions of the occuluded tubing, which are in the form of a teardrop shape, against sloped, inner roller surfaces 52 and concave side roller surfaces 54. The geometry of the occluding structure provides a desired distribution of forces to occlude the tubing. The design transmits a relatively low force at the center portion of the occluded tubing because of the concave mid-portion. A relatively greater force is provided at the peripheral portions of the occluded tubing which are the most difficult portions to occlude through the use of a mechanical advantage that is derived from the wedge shape of the projecting occluding surface. The resulting effect is that the force required to occlude the tubing is minimized, thereby increasing the life of the tubing. The linear pump described herein occludes the tubing in a similar manner. FIG. 10 illustrates the geometry of the occluded tubing, which is the same whether the pump is linear or peristaltic. The lower half of tubing 101 generally conforms to the original tubing shape. The peripheral portions of the occluded transverse section contain most of the strain energy stored within the occluded tubing. When the occluding force is removed, most of the stored strain energy is utilized to cause the top half portion to spring back to an open position.

Cross-sectional geometry similar to that illustrated in FIG. 3 is illustrated in FIG. 8.

Referring to FIG. 5, there is illustrated a side view of a portion of pump head 14 illustrating a portion of opposing exterior housing members 36*a* and 36*b*. Each of opposing exterior housing members 36*a* and 36*b* have mounted therein a guide pin 62 in a press-fit relationship, the pair of guide pins 62 defining a guide to assist insertion of the flexible tubing in housing 12 of peristaltic pump 10. Two sets of such guide pins 62 are provided in opposing exterior housing members 36, spaced apart 180 degrees on pump head 14.

An alternate embodiment peristaltic pump could have the housing surface define the recessed occluding surface and the rollers could define the projecting occluding surface. This embodiment is partially illustrated in FIG. 11, wherein a housing 64 defines a recessed occluding surface 66 and projecting occluding surface 68 is defined by roller 70 for occluding tubing 72. Each of the occluding surfaces are of a geometry as previously described.

In another peristaltic pump embodiment (not shown) the occluding surface defined by the housing could be spring-urged against the rollers. In other embodiments, the spring urging feature would be eliminated.

Referring now to FIG. 6, therein illustrated in perspective view a linear pump 100 and a flexible tubing 101. Linear pump 100 includes a back-up plate or housing 102 and a plurality of pump fingers each designated by a reference numeral 104, 106, 108 and 110, respectively. A structure for guiding fingers 104–110 and means for moving the fingers to and away from the back-up plate is also provided, but not shown, since these elements are well known.

Back-up plate or housing 102 in the illustrated embodiment defines a recessed first occluding surface 112. Recessed first occluding surface 112 includes a slightly concave, elongated mid-portion surface 114 that preferably has a width that is equal to about one-half of the inner circumference of the flexible tubing.

Recessed first occluding surface 112 further includes at each end of slightly concave mid-portion 114 a sloped, elongated planar surface 116 that forms an angle 118 at the intersection with slightly concave mid-portion 114 of about 135°. The length of sloped, planar mid-portions 116, referred to by reference number 120 is preferably equal to about one-third to one-quarter of the length of slightly concave mid-portion 114.

Preferably, and as illustrated in FIG. 6, the radius of curvature slightly concave mid-portion 114 is about five times the outer radius of the flexible tubing.

Recessed first occluding surface 112 further includes an elongated concave side surface 122 that defines a pocket in housing 102 at the end of each sloped, planar surface 116 opposite the end of sloped, planar surface 116 at concave mid-portion 114. Preferably, and as is illustrated in FIG. 6, the combined height of sloped, planar surface 116 and concave side surface 122 above concave mid-portion 114, referred to by reference numeral 124 is equal to about one-half of the outer diameter of the flexible tubing.

The sidewall surfaces 126 of housing 102 can serve to define a guide for pump fingers 104–110 and can facilitate the containment and centering of the flexible tubing, but are not directly involved in the occluding of the tubing.

Each of pump fingers 104–110 are periodically serially movable to periodically occlude distinct transverse sections of tubing between a particular pump finger and housing 102 for pumping fluid through the tubing. The structure utilized to move pump fingers 104–110 in a periodic and serial manner is not illustrated since such structure is well known to those skilled in the art and the particular structure utilized is not critical to practicing the invention.

Each of pump fingers 104–110 define a projecting second occluding surface 128 as better illustrated in FIGS. 8–10. Projecting second occluding surface 128 defines a wedge-shaped transverse cross section at the areas of contact with the transverse cross section of the tubing during the occlusion. Projecting second occluding surface of pump fingers 104–110 is wedge-shaped and includes a central planar finger surface that defines a straight mid-portion of the wedge-shaped transverse cross section. Projecting second occluding surface 128 is preferably of a width equal to about one-half of the inner circumference of the tubing for urging a transverse portion of the tubing against slightly concave mid-portion 114 of recessed first occluding surface 112.

Projecting second occluding surface 128 further includes at each end of central planar finger surface 130 a planar side portion 132 which preferably form an angle 134 at the intersection with central planar finger surface 130 of about 255°.

Preferably, and as illustrated in FIGS. 8–10, the intersection of each of planar side portions 132 and central planar surface 130 defines a curved edge 136. The purpose of curved edge 136 is to uniformly distribute forces on the flexible tubing when in an occluded position as illustrated in FIG. 9 and to prevent formation of the tubing adjacent curved edge 136 which could occur, for example, if curved edge 136 was not curved or rounded. The actual degree of curvature is not important as long as it is sufficient to prevent excessive deformation of the tubing.

As illustrated in FIGS. 8–10, the cross-sectional area of the tubing wall remains constant. However, the tubing walls become thinner during occlusion which results in the expansion of the inner and outer circumference of tubing 101.

FIGS. *7a–d* are side views of linear pump 100 illustrating part of a pumping cycle. It is to be understood that linear pump functions in a manner similar to that of previous finger pumps. During pumping, one of the pump's fingers will be in a tubing occluding position to prevent the free flow of fluid.

In FIG. *7a,* pump finger 104, which is located at the inlet 137 of linear pump 100, has fully advanced on tubing 101 occluding that portion of tubing 101 adjacent pump finger 104 and housing 102. Meanwhile, pump finger 106 is advancing on tubing 101 causing a mass of fluid to be transported in the direction of the outlet 138 of linear pump 100. At the same time, pump finger 108 is also advancing towards tubing 101.

In FIG. *7b,* pump finger 106 has fully occluded tubing 101 while pump finger 104 is retracting from tubing 101 allowing additional fluid to enter the portion of tubing 101 adjacent pump finger 104 that had been previously occluded. Pump finger 108 is beginning to occlude the section of tubing 101 adjacent thereto while pump finger 110 is also beginning to advance on tubing 101.

In FIG. *7c* pump finger 108 has fully occluded the section of tubing 101 adjacent thereto and pump finger 110 is beginning to occlude the section of tubing 101 adjacent thereto. At the same time, pump finger 106 is retracting from tubing 101 and pump finger 104 is fully retracted from tubing 101.

In FIG. *7d,* pump finger 110 has fully occluded the section of tubing 101 adjacent thereto causing further displacement of the fluid. Finger 104 begins to occlude the section of tubing 101 adjacent thereto as the periodic pumping cycle begins.

While in the illustrated embodiment, linear pump 100 is constructed such that housing 102 defines recessed first occluding surface 112 and pump fingers 104–110 defines projecting second occluding surface 128, it is to be understood that in an alternate embodiment, the housing would define the projecting occluding surface and the pump fingers would define the recessed first occluding surface. This embodiment is illustrated in FIG. 12, wherein a housing 140 defines a projecting occluding surface 142 and a plurality of pump fingers 144, 146, 148 and 150 define a recessed occluding surface for occluding tubing 152. Each of the occluding surfaces are of a geometry as previously described.

While the invention has been described with respect to preferred embodiments, it will be understood that the invention is capable of numerous changes, modifications and rearrangements and such are intended to be covered by the appended claims.

I claim:

1. In a tubing occluder pump where fluid is pumped by the periodic occlusion of transverse sections of flexible tubing along a length thereof, the improvement comprising:

means for occluding the tubing between a recessed first occluding surface means and a projecting second occluding surface means;

said recessed first occluding surface means defining a transverse cross section at the areas of contact with said transverse sections of the tubing during occlusion, said transverse cross section of said first recessed occluding surface means having a slightly concave mid-portion, at each end of said slightly concave mid-portion, a sloped, straight portion, each sloped, straight portion forming an angle at the inersection with said slightly concave mid-portion of between about 120° and 150° and a concave side defining an indentation in said first occluding cross section at the end of each sloped, straight portion opposite the end at said slightly concave mid-portion;

said projecting second occluding surface means defining a wedge-shaped transverse cross section at the areas of contact with said transverse sections of said tubing during occlusion, said cross section of said second occluding surface means having a straight mid-portion of a length substantially equal to the length of said slightly concave mid-portion for urging a transverse portion of tubing against the slightly concave mid-portion cross section of said recessed first occluding surface means and a straight side portion extending from said straight mid-portion at each end of said straight mid-portion and forming an angle with the intersection of said straight mid-portion of between about 225° and 270° for urging transverse ends of the transverse portion of the tubing against the sloped and concave side portions of said recessed first occluding surface means.

2. The tubing occluder pump of claim 1 wherein the length of said slightly concave mid-portion is equal to about one-half of the inner circumference of the tubing.

3. The tubing occluder pump of claim 1 wherein said pump is a peristaltic pump having a pump head carrying a plurality of rollers, each defining one of said tubing occluding surface means and a curved housing defining the other of said tubing occluding surface means.

4. The tubing occluder pump of claim 3 wherein said rollers comprise said recessed occluding surface means.

5. The tubing occluder pump of claim 4 wherein each of said rollers includes a central slightly concave roller surface defining said slightly concave cross section of said first recessed occluding surface means, a sloped, planar roller surface extending from each end of said slightly concave roller surface defining said sloped, straight portions of said first occluding surface means cross section and a concave side roller surface at the outer peripheral end of each of said sloped, planar roller surfaces defining said concave side indentations of said first occluding surface means cross section.

6. The tubing occluder pump of claim 5 wherein said curved housing defines said projecting second occluding surface means including a central flat surface defining said straight mid-portion of said wedge-shaped transverse cross section and a peripheral flat surface at each side of said central flat surface of said housing defining said straight side portions of said wedge-shaped transverse cross section.

7. The tubing occluder pump of claim 3 wherein said rollers comprise said projecting second occluding surface means.

8. The tubing occluder pump of claim 7 wherein each of said rollers is wedge-shaped and includes a central planar roller surface defining said straight mid-portion of said wedge-shaped transverse cross section and a peripheral planar surface at each side of said central planar roller surface defining said straight side portions of said wedge-shaped transverse cross section.

9. The tubing occluder pump of claim 8 wherein said curved housing defines said recessed first occluding surface means including a central slightly concave surface defining said slightly concave cross section of said recessed first occluding surface means, a sloped, planar surface extending from each side of said slightly concave surface defining said sloped, straight portions of said first occluding surface means cross section and a concave surface at the side end of each of said sloped, planar surfaces opposite said slightly concave surface defining said concave side indentations of said first occluding surface means cross section.

10. The tubing occluder pump of claim 1 wherein said pump is a linear pump having a pump housing and a plurality of pump fingers periodically serially movable to periodically occlude distinct transverse sections of tubing, each section located between one of said pump fingers and said pump housing for pumping fluid through said tubing, each of said fingers defining one of said tubing occluding surface means and said pump housing defining the other of said tubing occluding surface means.

11. The tubing occluder pump of claim 10 wherein said pump fingers comprise said recessed first occluding surface means.

12. The tubing occluder pump of claim 11 wherein each of said pump fingers includes a recessed tubing occluding surface having a slightly concave finger mid-portion surface defining said slightly concave cross section of said recessed first occluding surface means, a sloped, planar finger surface extending from each side of said slightly concave finger surface defining said sloped planar straight portions of said first occluding surface means cross section and a concave side finger surface at the end of each of said sloped, planar finger surfaces opposite said slightly concave finger surface defining said concave side indentations of said first occluding surface means cross section.

13. The tubing occluder pump of claim 12 wherein said pump housing defines said projecting second occluding surface means and includes a planar mid-portion surface defining said straight mid-portion of said wedge-shaped transverse cross section and a peripheral planar surface at each end of said planar midportion surface defining said straight side portions of said wedge-shaped transverse cross section.

14. The tubing occluder pump of claim 10 wherein said pump fingers comprise said projecting second occluding surface means.

15. The tubing occluder pump of claim 14 wherein each of said pump fingers is wedge-shaped and includes a central planar finger surface defining said straight mid-portion of said wedge-shaped transverse cross section and a peripheral planar surface at each end of said central planar finger surface defining said straight side portions of said wedge-shaped transverse cross section.

16. The tubing occluder pump of claim 15 wherein said pump housing defines said recessed first occluding surface means and includes a slightly concave mid-portion surface defining said slightly concave cross section of said recessed first occluding surface means, a sloped, planar surface extending from each side of said slightly concave surface defining said sloped, straight portions of said first occluding surface means cross section and a concave surface at the end of each of said sloped, planar surfaces opposite said slightly concave surface defining said concave side indentations of said first occluding surface means cross section.

17. The tubing occluder pump of claim 1 wherein the angle formed at the intersection of each of said sloped, straight portions with said slightly concave mid-portion is about 135°.

18. The tubing occluder pump of claim 1 wherein each of said convcave sides comprises a curved indentation having a radius of curvature of about one-third of the outer radius of the tubing in the uncompressed state.

19. The tubing occluder pump of claim 1 wherein the intersection of each of said straight side portions with said straight mid-portion is a rounded corner.

20. The tubing occluder pump of claim 1 wherein the intersection of said straight mid-portion and each of said straight side portions forms an angle of about 255°.

21. The tubing occluder pump of claim 1 wherein said slightly concave mid-portion has a radius of curvature equal to about five times the outer radius of the tubing in the uncompressed state.

22. The tubing occluder pump of claim 1 wherein said recessed first occluding surface means and said projecting second occluding surface means comprise resilient material.

23. The tubing occluder pump of claim 1 wherein said sloped straight portions each are of a length equal to about one-third to one-quarter of the length of said concave mid-portion.

* * * * *